US008044919B2

(12) United States Patent
Song et al.

(10) Patent No.: US 8,044,919 B2
(45) Date of Patent: Oct. 25, 2011

(54) BACKLIGHT DRIVING APPARATUS OF LCD AND DRIVING METHOD THEREOF

(75) Inventors: Hong Sung Song, Gyeongsangbuk-do (KR); Byung Jin Choi, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1089 days.

(21) Appl. No.: 11/896,096

(22) Filed: Aug. 29, 2007

(65) Prior Publication Data

US 2008/0055232 A1 Mar. 6, 2008

(30) Foreign Application Priority Data

Aug. 30, 2006 (KR) ..... 10-2006-0082999

(51) Int. Cl.
*G09G 3/26* (2006.01)
*H05B 41/14* (2006.01)

(52) U.S. Cl. ..... 345/102; 315/225

(58) Field of Classification Search ..... 345/87, 345/102, 213; 349/61, 67, 70; 315/225, 315/291, 307

See application file for complete search history.

(56) References Cited

U.S. PATENT DOCUMENTS

| | | | | |
|---|---|---|---|---|
| 5,844,540 | A * | 12/1998 | Terasaki | 345/102 |
| 6,316,881 | B1 * | 11/2001 | Shannon et al. | 315/219 |
| 6,531,831 | B2 * | 3/2003 | Chou et al. | 315/225 |
| 6,593,709 | B2 * | 7/2003 | Lee et al. | 315/302 |
| 6,633,138 | B2 * | 10/2003 | Shannon et al. | 315/224 |
| 7,161,309 | B2 * | 1/2007 | Chiou et al. | 315/291 |
| 7,291,991 | B2 * | 11/2007 | Chen | 315/307 |

* cited by examiner

*Primary Examiner* — Kevin M Nguyen

(74) *Attorney, Agent, or Firm* — Morgan, Lewis & Bockius LLP

(57) ABSTRACT

An inverter of a liquid crystal display for receiving a power voltage for burst dimming via one power terminal to simultaneously adjust a burst dimming and an analog dimming is disclosed. In the inverter of the liquid crystal display, a burst dimming signal generator receives a triangular-wave signal and a power voltage for burst dimming to generate a burst dimming signal. An analog dimming voltage generator receives the power voltage for burst dimming to generate an analog dimming voltage. And a main controller receives the burst dimming signal and the analog dimming voltage to generate a pulse width modulating signal which is used for generating a driving current of a backlight assembly.

5 Claims, 7 Drawing Sheets

BACKLIGHT DRIVING APPARATUS OF LCD AND DRIVING METHOD THEREOF

This application claims the benefit of Korean Patent Application No. P2006-082999 filed in Korea on Aug. 30, 2006, which is hereby incorporated by reference.

BACKGROUND OF THE INVENTION

1. Field of the Invention

The present invention relates to a backlight driving apparatus, and more particularly to a backlight driving apparatus of a liquid crystal display that is adaptive for receiving a power voltage for burst dimming via one power terminal to simultaneously adjust a burst dimming and an analog dimming, and a driving method thereof.

2. Description of the Related Art

Generally, a liquid crystal display controls light transmittance of liquid crystal cells in accordance with video signals to thereby display a picture. An active matrix type of liquid crystal display having a switching device provided for each liquid crystal cell is advantageous for an implementation of moving picture because it permits an active control of the switching device. The switching device used for the active matrix liquid crystal display mainly employs a thin film transistor (hereinafter, referred to as "TFT") as shown in FIG. 1.

Referring to FIG. 1, the liquid crystal display of the active matrix type converts a digital input data into an analog data voltage on the basis of a gamma reference voltage to supply it to a data line DL and, at the same time supply a scanning pulse to a gate line GL, thereby charging a liquid crystal cell Clc.

A gate electrode of the TFT is connected to the gate line GL, a source electrode is connected to the data line DL, and a drain electrode of the TFT is connected to a pixel electrode of the liquid crystal cell Clc and one end electrode of a storage capacitor Cst.

A common electrode of the liquid crystal cell Clc is supplied with a common voltage Vcom.

When the TFT is turned-on, the storage capacitor Cst charges a data voltage applied from the data line DL to constantly maintain a voltage of the liquid crystal cell Clc.

If the gate pulse is applied to the gate line GL, the TFT is turned-on to define a channel between the source electrode and the drain electrode, thereby supplying a voltage on the data line DL to the pixel electrode of the liquid crystal cell Clc. In this case, liquid crystal molecules of the liquid crystal cell Clc are arranged by an electric field between the pixel electrode and the common electrode to modulate an incident light.

A configuration of the related art liquid crystal display including pixels which have such a structure is the same as shown in FIG. 2.

FIG. 2 is a block diagram showing a configuration of the related art liquid crystal display.

Referring to FIG. 2, a liquid crystal display 100 includes a liquid crystal display panel 110, a data driver 120, a gate driver 130, a gamma reference voltage generator 140, a backlight assembly 150, a common voltage generator 160, a gate driving voltage generator 170, a timing controller 180, and an inverter 190. Herein, the data driver 120 supplies a data to the data lines DL1 to DLm of the liquid crystal display panel 110. The gate driver 130 supplies a scanning pulse to the gate lines GL1 to GLn of the liquid crystal display panel 110. The gamma reference voltage generator 140 generates a gamma reference voltage to supply it to the data driver 120. The backlight assembly 150 irradiates a light onto the liquid crystal display panel 110. The common voltage generator 160 generates a common voltage Vcom to supply it to a common electrode of the liquid crystal cell Clc of the liquid crystal display panel 110. The gate driving voltage generator 170 generates a gate high voltage VGH and a gate low voltage VGL to supply them to the gate driver 130. The timing controller 180 controls the data driver 120 and the gate driver 130. The inverter 190 applies an AC voltage and a current to the backlight assembly 150.

The liquid crystal display panel 110 has a liquid crystal dropped between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse applied, via the gate lines GL1 to GLn, to the gate terminal thereof. Upon turning-on of the TFT, a video data on the data lines DL1 to DLm is supplied to the pixel electrode of the liquid crystal cell Clc.

The data driver 120 supplies a data to the data lines DL1 to DLm in response to a data driving control signal DDC which is supplied from the timing controller 180. Further, the data driver 120 converts digital video data RGB which are supplied from the timing controller 180 into an analog data voltage on the basis of a gamma reference voltage from the gamma reference voltage generator 140 to supply it the data lines DL1 to DLm. Herein, the analog data voltage is realized as a gray scale at the liquid crystal cell Clc of the liquid crystal display panel 110.

The gate driver 130 sequentially generates a scanning pulse in response to a gate driving control signal GDC and a gate shift clock GSC which are supplied from the timing controller 180 to supply it to the gate lines GL1 to GLn. In this case, the gate driver 130 determines a high level voltage and a low level voltage of the scanning pulse in accordance with the gate high voltage VGH and the gate low voltage VGL which are supplied from the gate driving voltage generator 170.

The gamma reference voltage generator 140 receives a high-level power voltage VDD to generate a positive gamma reference voltage and a negative gamma reference voltage and output them to the data driver 120.

The backlight assembly 150 is provided at the rear side of the liquid crystal display panel 110, and is radiated by an AC voltage and a current which are supplied from the inverter 190 to irradiate a light onto each pixel of the liquid crystal display panel 110.

The common voltage generator 160 receives a high-level power voltage VDD to generate a common voltage Vcom, and supplies it to the common electrode of the liquid crystal cell Clc provided at each pixel of the liquid crystal display panel 110.

The gate driving voltage generator 170 is supplied with a high-level power voltage VDD to generate the gate high voltage VGH and the gate low voltage VGL, and supplies them to the gate driver 130. Herein, the gate driving voltage generator 170 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 180 supplies digital video data RGB which are supplied from a system such as a TV set or a computer monitor, etc to the data driver 120. Furthermore, the timing controller 180 generates a data driving control signal DCC and a gate driving control signal GDC using horizontal/vertical synchronization signals H and V in response to a clock signal CLK to supply them to the data driver 120 and the gate driver 130, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The inverter 190 receives a power voltage for burst dimming of 0V to 3.3V from a system to generate a burst dimming signal, and then adjusts a duty ratio of a pulse width modulating signal PWM which is used for generating a driving current of the backlight assembly 150 in accordance with the burst dimming signal. At the same time, the inverter 190 alternatively receives a power voltage for analog dimming of 0V, 1.65V, and 3.3V from a system to adjust amplitude of a pulse width modulating signal PWM.

Such an inverter 190 adjusts a supply period of a driving current of the backlight assembly 150 in proportion to a duty ratio of a pulse width modulating signal PWM and, at the same time adjusts amplitude of a driving current of the backlight assembly 150 in proportion to amplitude of a pulse width modulating signal PWM. Herein, the inverter 190 receives a power voltage for burst dimming via one power terminal and receives a power voltage for analog dimming via the other power terminal.

In this way, a backlight driving apparatus of the related art, that is, since the inverter 190 receives a power voltage for burst dimming and a power voltage for analog dimming via two power terminals, respectively, a system is designed to separately supply a power voltage for burst dimming and a power voltage for analog dimming. The inverter 190 of the related art has a disadvantage in that a configuration of supplying power path and a circuit configuration of the system are complicated.

SUMMARY OF THE INVENTION

The present invention is to solve the above-mentioned problem. Accordingly, it is an object of the present invention to provide a backlight driving apparatus of a liquid crystal display that is adaptive for receiving a power voltage for burst dimming via one power terminal to simultaneously adjust a burst dimming and an analog dimming, and a driving method thereof.

It is another object of the present invention to provide a backlight driving apparatus of a liquid crystal display that is adaptive for receiving only power voltage for burst dimming from a system to simultaneously adjust a burst dimming and an analog dimming, thereby simplify a process of supplying power and a circuit configuration of a system, and a driving method thereof.

It is still another object of the present invention to provide a backlight driving apparatus of a liquid crystal display that is adaptive for receiving only power voltage for burst dimming from a system to simultaneously adjust a burst dimming and an analog dimming, thereby simplifying a process of supplying power and a circuit configuration of a system and maintaining a contrast ratio, and a driving method thereof.

In order to achieve these and other objects of the invention, a backlight driving apparatus of a liquid crystal display according to the present invention comprises a burst dimming signal generator receiving a triangular-wave signal and a power voltage for burst dimming to generate a burst dimming signal; an analog dimming voltage generator receiving the power voltage for burst dimming to generate an analog dimming voltage; and a main controller receiving the burst dimming signal and the analog dimming voltage to generate a pulse width modulating signal which is used for generating a driving current of a backlight assembly.

The burst dimming signal is a comparator that includes an inversing input terminal which receives the triangular-wave signal, a non-inversing input terminal which receives the power voltage for burst dimming, and an output terminal which outputs the burst dimming signal.

The comparator senses the power voltage for burst dimming which is inputted to the non-inversing input terminal on the basis of the triangular-wave signal which is inputted to the inversing input terminal to output the burst dimming signal to the output terminal.

The analog dimming voltage generator receives the power voltage for burst dimming to generate a plurality of analog dimming voltages.

The power voltage for burst dimming which is inputted to the burst dimming signal generator and the analog dimming voltage generator is simultaneously inputted via one power terminal.

The main controller adjusts a duty ratio of the pulse width modulating signal to have a duty ratio which is proportional to a duty ratio of the burst dimming signal and, at the same time adjusts amplitude of the pulse width modulating signal in proportion to a level of the analog dimming voltage.

A method of driving a backlight of a liquid crystal display according to the present invention comprises receiving a power voltage for burst dimming to generate a burst dimming signal; receiving the power voltage for burst dimming to generate an analog dimming voltage; generating a pulse width modulating signal which has a duty ratio proportional to the burst dimming signal and amplitude proportional to a level of the analog dimming voltage; and generating a driving current of a backlight assembly in accordance with the pulse width modulating signal.

In the method, a duty ratio of the pulse width modulating signal is adjusted to have a duty ratio which is proportional to a duty ratio of the burst dimming signal and, at the same time amplitude of the pulse width modulating signal is adjusted in proportion to a level of the analog dimming voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to the accompanying drawings.

Figure 1:
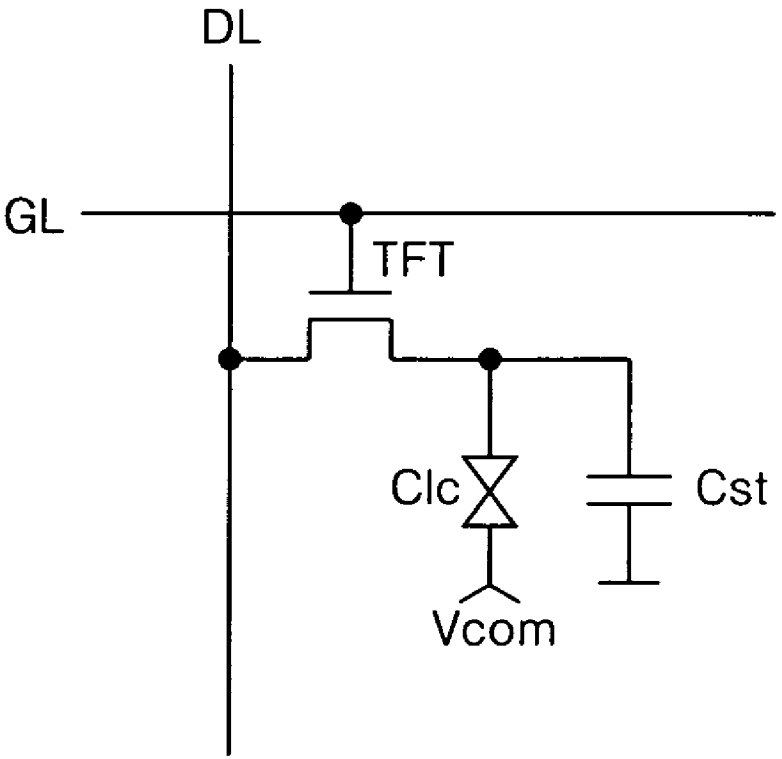
FIG. 1 RELATED ART
FIG. 1 is an equivalent circuit diagram showing a pixel provided at a liquid crystal display of the related art.
Figure 2:
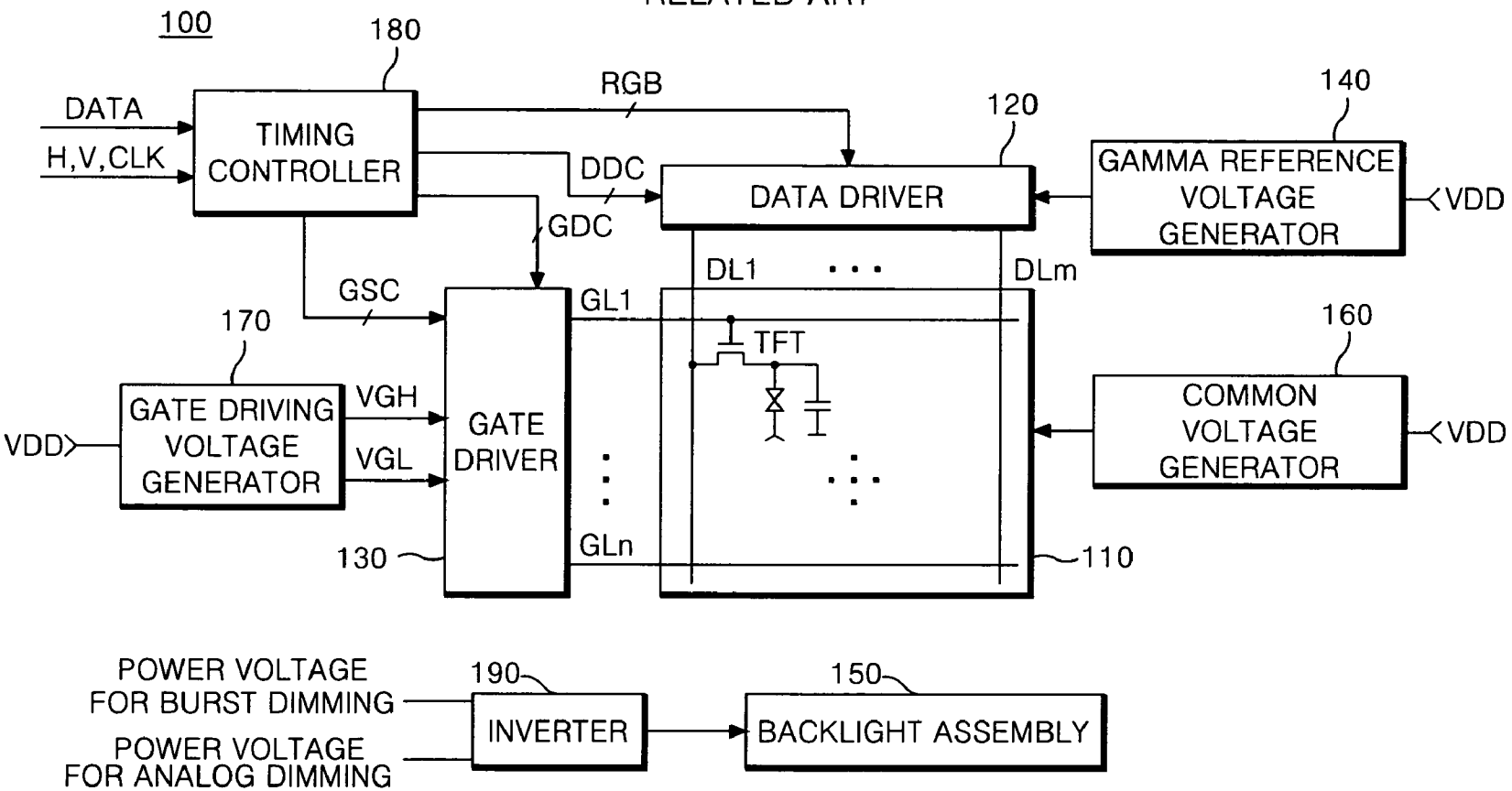
FIG.2 RELATED ART
FIG. 2 is a block diagram showing a configuration of the liquid crystal display of the related art.
Figure 3:
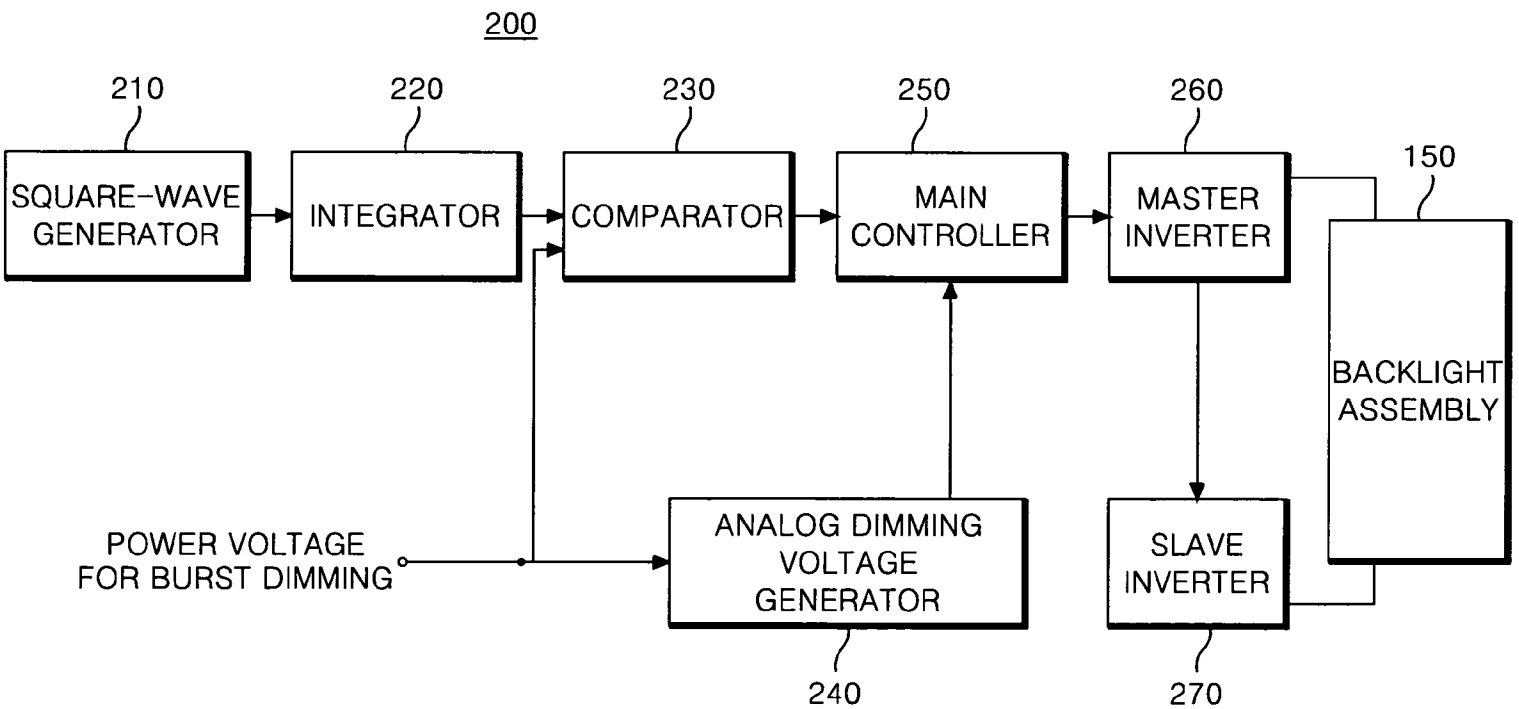
FIG. 3 is a block diagram showing a configuration of a backlight driving apparatus of a liquid crystal display according to an embodiment of the present invention.

FIG. 3 is a block diagram showing a configuration of a backlight driving apparatus of a liquid crystal display according to an embodiment of the present invention.

Referring to FIG. 3, a backlight driving apparatus 200 includes a square-wave generator 210, an integrator 220, a comparator 230, an analog dimming voltage generator 240, a main controller 250, a master inverter 260, and a slave inverter. Herein, the square-wave generator 210 generates a constant square-wave signal. The integrator 220 converts a constant square-wave signal which is generated from the square-wave generator 210 into a triangular-wave signal. The comparator 230 compares a triangular-wave signal which is converted by the integrator 220 with a power voltage for burst dimming from a system to generate a burst dimming signal. The analog dimming voltage generator 240 receives a power voltage for burst dimming from a system to generate an analog dimming voltage. The main controller 250 generates a pulse width modulating signal which has a duty ratio proportional to a duty ratio of a burst dimming signal from the comparator 230 and amplitude proportional to a level of an analog dimming voltage from the analog dimming voltage generator 240. The master inverter 260 generates a driving current in accordance with a duty ratio of a pulse width modulating signal from the main controller 250 to supply it to the end of one side of the backlight assembly 150 and, at the same time adjust amplitude of a driving current in proportion to amplitude of a pulse width modulating signal. The slave inverter 270 generates a driving current in accordance with a duty ratio of a pulse width modulating signal which is supplied via the master inverter 260 to supply it to the end of the other side of the backlight assembly 150 and, at the same time adjust amplitude of a driving current in proportion to amplitude of a pulse width modulating signal.

Figure 4A:
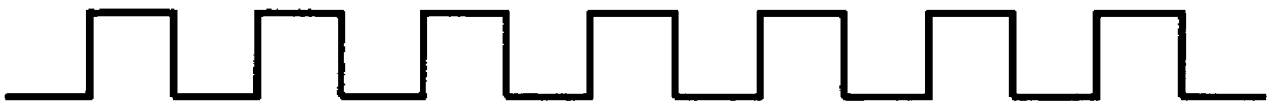
FIG. 4A is a diagram showing a characteristics of a square-wave signal which is generated from the square-wave generator in FIG. 3.

The square-wave generator 210 generates a square-wave signal which is used for generating a burst dimming signal to supply it to the integrator 220. Herein, a square-wave signal has a constant duty ratio as shown in FIG. 4A.

Figure 4B:
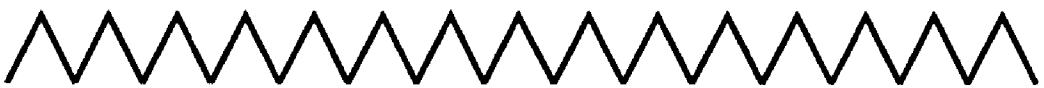
FIG. 4B is a diagram showing a characteristics of a triangular-wave signal which is generated from the integrator in FIG. 3.

The integrator 220 converts a square-wave signal which is generated from the square-wave generator 220 into a triangular-wave signal as shown in FIG. 4B to output it to the comparator 230. A circuit configuration of the integrator 220 will be described in detail with reference to FIG. 5.

Figure 4C:
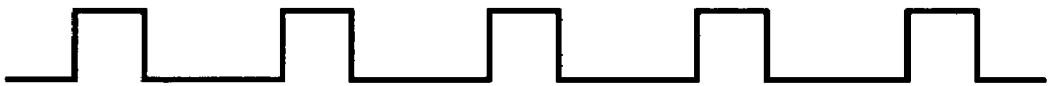
FIG. 4C is a diagram showing a characteristics of a burst dimming signal which is generated from the comparator in FIG. 3.

The comparator 230 receives a triangular-wave signal from the integrator 220 and a power voltage for burst dimming (DC of 0V to 3.3V) from a system to output a burst dimming signal as shown in FIG. 4C to the main controller 250.

The analog dimming voltage generator 240 receives a power voltage for burst dimming (DC of 0V to 3.3V) from a system to an analog dimming voltage which is used for adjusting amplitude of a pulse width modulating signal, thereby outputting it to the main controller 250. Herein, the analog dimming voltage generator 240 generates an analog dimming voltage in proportion to a level of the inputted power voltage for burst dimming (DC of 0V to 3.3V). For example, the analog dimming voltage generator 240 generates an analog dimming voltage of 0V, 1.65V, and 3.3V.

More specifically, if the inputted power voltage for burst dimming is a range of about 0V to 0.82V, the analog dimming voltage generator 240 generates an analog dimming voltage of 0V to output it to the main controller 250. If the inputted power voltage for burst dimming is a range of about 0.83V to 1.61V, the analog dimming voltage generator 240 generates an analog dimming voltage of 1.65V to output it to the main controller 250. If the inputted power voltage for burst dimming is a range of about 1.61V to 3.3V, the analog dimming voltage generator 240 generates an analog dimming voltage of 3.3V to output it to the main controller 250.

The main controller 250 generates a pulse width modulating signal in accordance with a burst dimming signal from the comparator 230 and an analog dimming voltage from the analog dimming voltage generator 240 to supply it to the master inverter 260. Herein, the main controller 250 adjusts a duty ratio of a pulse width modulating signal to have a duty ratio proportional to a duty ratio of a burst dimming signal which is supplied from the comparator 230 and, at the same time adjusts amplitude of a pulse width modulating signal to have amplitude proportional to a level of an analog dimming voltage which is supplied from the analog dimming voltage generator 240.

For example, if an analog dimming voltage of 0V is supplied from the analog dimming voltage generator 240, the main controller 250 decreases amplitude of a pulse width modulating signal to a minimum. If an analog dimming voltage of 3.3V is supplied from the analog dimming voltage generator 240, the main controller 250 amplifies amplitude of a pulse width modulating signal to a maximum. If an analog dimming voltage of 1.65V is supplied from the analog dimming voltage generator 240, the main controller 250 adjusts a pulse width modulating signal to have an intermediate width between a minimum width and a maximum width.

Specially, in the present invention, a power voltage for burst dimming (DC of 0V to 3.3V) from a system is simultaneously inputted, via one power terminal, to the comparator 230 and the analog dimming voltage generator 240.

The master inverter 260 generates a driving current of the backlight assembly 150 in accordance with a pulse width modulating signal from the main controller 250 to supply it to the end of one side of the backlight assembly 150 and, at the same time supply a pulse width modulating signal from the main controller 250 to the slave inverter 270. Herein, the master inverter 260 adjusts a supply period of a driving current of the backlight assembly 150 in accordance with a duty ratio of a pulse width modulating signal which is supplied from the main controller 250 and, at the same time adjusts amplitude of a driving current of the backlight assembly 150 in accordance with amplitude of a pulse width modulating signal which is supplied from the main controller 250.

The slave inverter 270 generates a driving current of the backlight assembly 150 in accordance with a pulse width modulating signal which is supplied via the master inverter 260 to supply it to the end of the other side of the backlight assembly 150. Herein, the slave inverter 270 adjusts a supply period of a driving current of the backlight assembly 150 in accordance with a duty ratio of a pulse width modulating signal which is supplied via the master inverter 260 and, at the same time adjusts amplitude of a driving current of the backlight assembly 150 in accordance with amplitude of a pulse width modulating signal which is supplied via the master inverter 260. Such a slave inverter 270 generates a driving current having an reverse phase compared to a phase of a driving current which is supplied from the master inverter 260.

In this way, since the present invention simultaneously adjusts a duty ratio and amplitude of a pulse width modulating signal using a power voltage for burst dimming (DC of 0V to 3.3V) which is supplied, via one power terminal, from a system, the present invention simplifies a process of supplying power and a circuit configuration of the system. Furthermore, since the present invention simplifies a process of supplying power voltage from a system and maintains a duty ratio and amplitude of a pulse width modulating signal to be the same as the related art, the present invention simplifies a process of supplying power and a circuit configuration of the system and, at the same time maintains a contrast ratio.

Figure 5:
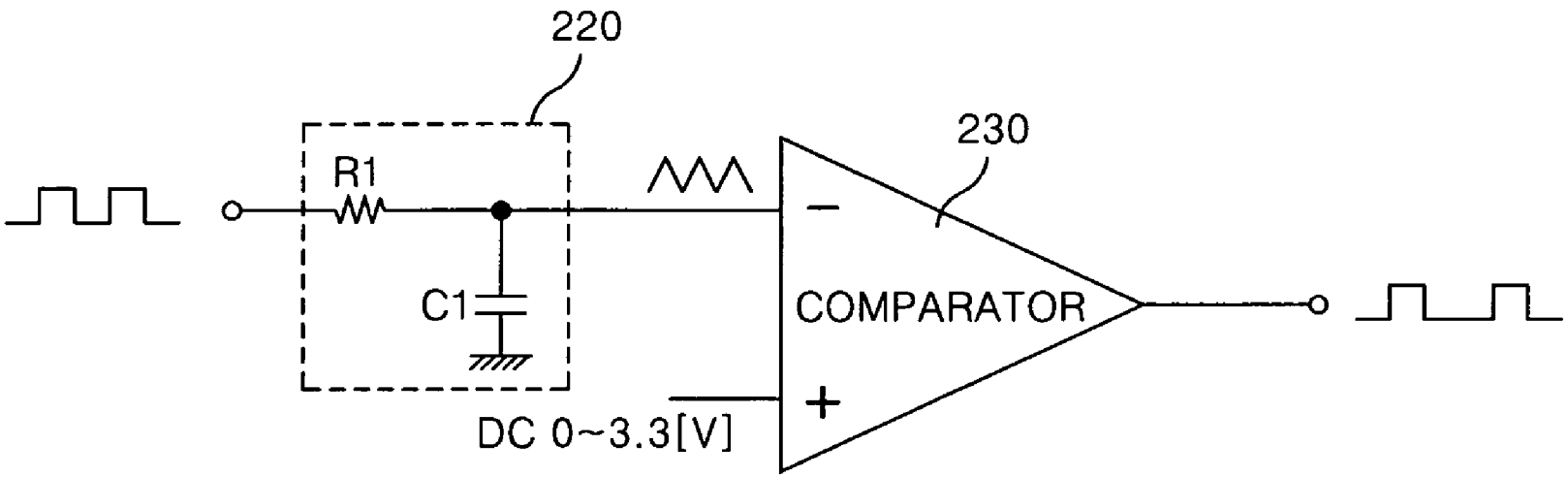
FIG. 5 is a circuit diagram showing the integrator and the comparator in FIG. 3.

FIG. 5 is a circuit diagram showing the integrator and the comparator in FIG. 3.

Referring to FIG. 5, the integrator 220 includes a resistor R1 and a capacitor C1 which are connected in parallel between an output terminal of the square-wave generator 210 and an input terminal of the comparator 230. Herein, the end of one side of the capacitor C1 is commonly connected to the resistor R1 and an input terminal of the comparator 230. The end of the other side of the capacitor C1 is connected to the ground. The integrator 220 having such a circuit configuration converts a square-wave signal which is generated from the square-wave generator 210 into a triangular-wave signal to input it to one input terminal of the comparator 230.

The comparator 230 receives a triangular-wave signal which is outputted, via an inversing input terminal (−), from the integrator 220 and receives a DC voltage of 0V to 3.3V via a non-inversing input terminal (+) to output a burst dimming signal via an output terminal.

The comparator 230 having such a circuit configuration senses a DC voltage which is inputted to a non-inversing input terminal (+) on the basis of a triangular-wave signal which is inputted to an inversing input terminal (−) to output a burst dimming signal to an output terminal. More specifically, a high signal should be outputted at an interval that a triangular-wave signal is higher than a DC voltage. However, since a triangular-wave signal is inputted to an inversing input terminal (−), an inversed signal of high signal, that is, a low signal is outputted. On the contrary, a low signal should be outputted at an interval that a triangular-wave signal is lower than a DC voltage. However, since a triangular-wave signal is inputted to an inversing input terminal (−), an inversed signal of low signal, that is, a high signal is outputted. Thus, the comparator 230 outputs a burst dimming signal as shown in FIG. 4C through a process of generating such a burst dimming signal.

As described above, the present invention receives only power voltage for burst dimming from a system to simultaneously adjust a burst dimming and an analog dimming. As a result, the present invention simplifies a configuration of supplying power path and a circuit configuration of the system and, at the same time maintains a contrast ratio.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A backlight driving apparatus of a liquid crystal display, comprising:

a burst dimming signal generator receiving a triangular-wave signal from an integrator and a power voltage from a system for burst dimming to generate a burst dimming signal;

an analog dimming voltage generator receiving the power voltage for burst dimming to generate an analog dimming voltage; and a main controller receiving the burst dimming signal and the analog dimming voltage to generate a pulse width modulating signal which is used for generating a driving current of a backlight assembly, wherein the main controller adjusts a duty ratio of the pulse width modulating signal to have a duty ratio which is proportional to a duty ratio of the burst dimming signal which is supplied from the burst dimming signal generator and, at the same time adjusts amplitude of the pulse width modulating signal in proportion to a level of the analog dimming voltage which is supplied from the analog dimming voltage generator, wherein the burst dimming signal generator includes a comparator, wherein the power voltage for burst dimming is simultaneously inputted, via one power terminal, to the comparator and the analog dimming voltage generator.

2. The backlight driving apparatus of the liquid crystal display according to claim 1, wherein the comparator includes an inversing input terminal which receives the triangular-wave signal, a non-inversing input terminal which receives the power voltage for burst dimming, and an output terminal which outputs the burst dimming signal.

3. The backlight driving apparatus of the liquid crystal display according to claim 1, wherein the comparator senses the power voltage for burst dimming which is inputted to the non-inversing input terminal on the basis of the triangular-wave signal which is inputted to the inversing input terminal to output the burst dimming signal to the output terminal.

4. The backlight driving apparatus of the liquid crystal display according to claim 1, wherein the analog dimming voltage generator receives the power voltage for burst dimming to generate a plurality of analog dimming voltages.

5. A method of driving a backlight of a liquid crystal display, comprising:

receiving a power voltage for burst dimming to generate a burst dimming signal;

receiving the power voltage for burst dimming to generate an analog dimming voltage;

generating a pulse width modulating signal which has a duty ratio proportional to the burst dimming signal and amplitude proportional to a level of the analog dimming voltage; and generating a driving current of a backlight assembly in accordance with the pulse width modulating signal, wherein a duty ratio of the pulse width modulating signal is adjusted to have a duty ratio which is proportional to a duty ratio of the burst dimming signal which is supplied from a burst dimming signal generator and, at the same time amplitude of the pulse width modulating signal is adjusted in proportion to a level of the analog dimming voltage which is supplied from an analog dimming voltage generator, wherein the power voltage for burst dimming is simultaneously inputted, via one power terminal, to a comparator and the analog dimming voltage generator.

* * * * *